US009057038B2

(12) United States Patent
Greaves et al.

(10) Patent No.: US 9,057,038 B2
(45) Date of Patent: Jun. 16, 2015

(54) CORROSION INHIBITING POLYALKYLENE GLYCOL-BASED LUBRICANT COMPOSITIONS

(75) Inventors: Martin R. Greaves, Hirzel (CH); Daniel Zweifel, Hirzel (CH); Evelyn A. Zaugg-Hoozemans, Horgen (CH)

(73) Assignee: Dow Global Technologies LLC, Midland, MI (US)

( * ) Notice: Subject to any disclaimer, the term of this patent is extended or adjusted under 35 U.S.C. 154(b) by 130 days.

(21) Appl. No.: 13/811,764

(22) PCT Filed: Aug. 17, 2011

(86) PCT No.: PCT/US2011/048092

§ 371 (c)(1), (2), (4) Date: Mar. 5, 2013

(87) PCT Pub. No.: WO2012/030537

PCT Pub. Date: Mar. 8, 2012

(65) Prior Publication Data

US 2013/0157909 A1 Jun. 20, 2013

Related U.S. Application Data

(60) Provisional application No. 61/378,757, filed on Aug. 31, 2010.

(51) Int. Cl.

| | |
|---|---|
| ***C10M 169/04*** | (2006.01) |
| ***C07C 303/44*** | (2006.01) |
| ***C07F 9/165*** | (2006.01) |
| ***C10M 111/04*** | (2006.01) |
| ***C10M 173/02*** | (2006.01) |
| ***C10M 129/40*** | (2006.01) |
| ***C10M 105/14*** | (2006.01) |

(52) U.S. Cl.

CPC ..... *C10M 105/14* (2013.01); *C10M 169/04* (2013.01); *C10M 2203/10* (2013.01); *C10M 2203/106* (2013.01); *C10M 2207/2835* (2013.01); *C10M 2207/288* (2013.01); *C10M 2209/104* (2013.01); *C10M 2209/1045* (2013.01); *C10M 2209/105* (2013.01); *C10M 2209/1055* (2013.01); *C10M 2209/106* (2013.01); *C10M 2209/1065* (2013.01); *C10M 2215/04* (2013.01); *C10M 2215/064* (2013.01); *C10M 2215/065* (2013.01); *C10M 2215/223* (2013.01); *C10M 2219/044* (2013.01); *C10M 2223/04* (2013.01); *C10M 2223/041* (2013.01); *C10M 2223/043* (2013.01); *C10M 2223/047* (2013.01); *C10M 2229/041* (2013.01); *C10N 2220/021* (2013.01); *C10N 2220/022* (2013.01); *C10N 2220/031* (2013.01); *C10N 2230/12* (2013.01); *C10N 2240/04* (2013.01)

(58) Field of Classification Search

CPC ..... C10M 2215/22; C10M 2219/044; C10M 2223/10; C10M 2207/282; C10M 2215/04; C10M 2223/04; C10M 2207/125

USPC ..... 508/282, 280, 416, 428, 440, 499, 513, 508/526

See application file for complete search history.

(56) References Cited

U.S. PATENT DOCUMENTS

| | | | | |
|---|---|---|---|---|
| 2005/0181958 | A1 | 8/2005 | Carey | |
| 2011/0039741 | A1 * | 2/2011 | Thoen et al. | 508/476 |
| 2012/0108482 | A1 * | 5/2012 | Greaves et al. | 508/579 |

FOREIGN PATENT DOCUMENTS

| | | |
|---|---|---|
| GB | 2 117 787 | 10/1983 |
| GB | 2117787 | 10/1983 |
| WO | WO 2009/134656 | 11/2009 |
| WO | WO2009/134656 | 11/2009 |
| WO | WO2009134656 | 11/2009 |

OTHER PUBLICATIONS

PCT Search Report dated Oct. 24, 2013; from PCT counterpart Application No. PCT/US2011/048092.

IPRP dated Mar. 14, 2013; from PCT counterpart Application No. PCT/US2011/048092.

Chinese Office Action dated Aug. 6, 2014; from Chinese counterpart Application No. 201180041799.3.

Instructions to Chinese Office Action dated Apr. 9, 2014; from Chinese counterpart Application No. 201180041799.3.

Response to Chinese Office Action dated Apr. 18, 2014; from Chinese counterpart Application No. 201180041799.3.

Written Opinion of the International Searching Authority dated Mar. 14, 2013; from PCT US/2011/048092.

Chinese Office Action dated Jan. 17, 2014; from Chinese counterpart Application No. 201180041799.3.

Instructions to Chinese Office Action dated Sep. 15, 2014; from Chinese counterpart Application No. 2011800417799.3.

Response to Chinese Office Action dated Sep. 22, 2014; from Chinese counterpart Application No. 2011800417799.3.

* cited by examiner

*Primary Examiner* — Vishal Vasisth

(57) ABSTRACT

Lubricant compositions including a random or block copolymer first high-EO content polyalkylene glycol, a random copolymer second polyalkylene glycol based on propylene oxide and butylene oxide or a second polyalkylene homopolymer having propylene oxide or butylenes oxide units and at least one corrosion inhibitor selected from the group of sarcosines, amine phosphates, and calcium dinonylnaphthalenesulfonate/carboxylates are provided. Lubricant compositions for extreme conditions are also provided.

15 Claims, No Drawings

CORROSION INHIBITING POLYALKYLENE GLYCOL-BASED LUBRICANT COMPOSITIONS

This application is a 371 of PCT/US11/48092, filed Aug. 17, 2011 which claims benefit of 61/378,757, filed Aug. 31, 2010.

This invention relates to lubricant compositions. More particularly, the invention relates to a polyalkylene glycol (PAG)-based lubricant compositions that resist corrosion using conventional corrosion inhibitors. The invention further relates to PAG-based, corrosion resistant lubricant compositions for use under extreme environmental and mechanical conditions, such as those experienced in wind turbine gearboxes.

One of the functional requirements of lubricants is to protect equipment from corrosion. For this reason many lubricant formulations, such as hydraulic fluids and gear lubricants, contain one or more corrosion inhibitor additives. Corrosion inhibitor additives generally perform extremely well in petroleum based lubricants generally requiring only low levels of such additives, e.g. less than 0.5% by weight, to effectively inhibit corrosion. However in polar base oils, such as polyalkylene glycol ("PAG"), the same corrosion inhibitor additives often fail to perform even at substantially higher, e.g. greater than 2% by weight, additive levels. This is especially true for PAG base oils that contain high levels of EO (>30%) as random or block structures.

One of the most common corrosion tests performed in the lubricants industry is ASTM. D665, which has two options for assessing corrosion performance. In ASTM D665A, the corrosion protection properties of the lubricant are assessed in combination with deionized water. In ASTM D665B, the corrosion protection properties of the lubricant are assessed in combination with synthetic sea water. Passing both these tests with a "pass" rating is highly preferred. However ASTM D665B is a much more difficult test to pass and furthermore it is known to be extremely difficult for formulations which contain PAGs as the primary base oil when the ethylene oxide ("EO") content of the PAG is high (i.e., high EO content is defined herein as 30 wt % EO based on total weight of the PAG). Several synthetic PAG-based lubricants are known. Many of these can easily pass the ASTM D665A test using conventional corrosion inhibitors. However, even with relatively high levels of conventional corrosion inhibitors, such known lubricants do not pass the harsher ASTM D665B test. Moreover, certain presently used engine oils do not use conventional corrosion inhibitors because such inhibitors may interfere with anti-wear additives. Thus, parts using such engine oils may be susceptible to corrosion. Another present approach for improving the corrosion inhibition properties of PAG-based lubricants is addition of one or more synthetic esters in compositions containing conventional corrosion inhibitors. One disadvantages of using esters in lubricants is their susceptibility to hydrolysis, which may lead to the breakdown of the lubricant and/or a rise in the acid number of the lubricant which, in turn, may cause corrosion.

As the use of non-petroleum based lubricants becomes increasingly common and desirable, a PAG-based lubricant composition containing a high content of EO and using conventional corrosion inhibitor would also be desirable. One of the advantages of using PAGs with a high EO content as a primary base oil in lubricants is excellent friction control which, in turn, may provide energy efficiency gains.

Certain applications of lubricants, such as in modern wind turbines used for energy production, encounter extreme environmental and mechanical conditions. A typical wind turbine includes, among other parts, a gearbox that houses gears connecting a low-speed shaft to a high-speed shaft. These shafts enable rotational speeds to vary from 40 rotations per minute ("rpm")-60 rpm to 1,500 rpm-1,800 rpm, the latter range representing a rotational speed required by most generators to produce electricity. Although wind turbines have an impressive record of reliability, when failures occur, they are often traced to gearbox bearing failure. The bearings must undertake extremely high loads, with constantly changing performance requirements. For example, under some operating conditions the bearing need to carry medium-sized loads at low speeds, while elsewhere the bearings need to carry much lower loads but at far high speeds. Furthermore, tight winds require bearings to carry high loads at tow speeds. These constantly varying conditions within the gearbox combine with often harsh environmental conditions, such as high temperatures, water, oxygen, and salts that contribute to corrosion and wear of bearings, with undesirable results. Either the lubricants break down, that is, kinematic viscosity ("KV") decreases, and a contact fatigue failure results, or the system requires an undesirably short oil drain interval, meaning that the turbine spends an unacceptable amount of time offline.

In general, lubricant formulations for wind turbine gear boxes now include synthetic, including PAG-based lubricants, rather than natural hydrocarbon oils. Certain PAG-based lubricants for use in extreme conditions include a polyol ester to boost corrosion inhibition. As previously mentioned, esters are susceptible to hydrolysis and may lead to the breakdown of the lubricant and corrosion.

Therefore, a PAG-based lubricant suitable for use in extreme conditions and which resists corrosion using conventional corrosion inhibitors would therefore be desirable.

A first aspect of the invention provides a lubricant composition comprising: a random or block copolymer first polyalkylene glycol based on ethylene oxide and propylene oxide, wherein at least 30 percent by weight of the polyalkylene glycol is ethylene oxide units; an effective amount of a random copolymer second polyalkylene glycol based on propylene oxide and butylene oxide, wherein at least 50 percent by weight of the second polyalkylene glycol is butylene oxide units; and an effective amount of at least one corrosion inhibitor selected from the group of sarcosines, amine salts of aliphatic phosphoric acid esters, and calcium dinonylnaphthalenesulfonate/carboxylates.

In one embodiment of the lubricant composition the effective amount of the second polyalkylene glycol is between 5 and 50 wt %.

In certain embodiments, the effective amount of the corrosion inhibitor is between 0.25 and 1.5 wt %.

In specific embodiments of the invention, the second polyalkylene glycol comprises between 50 and 75 wt % butylenes oxide units.

The first polyalkylene glycol has a kinematic viscosity at 40° C. between 30 and 250 $mm^2/s$ (cSt) in some embodiments of the invention.

In preferred embodiments, the lubricant composition is capable of passing ASTM D665B for at least 24 hours after initiation.

In some embodiments of the invention, a lubricant composition comprising: a random or block copolymer first polyalkylene glycol based on ethylene oxide and propylene oxide ("PO"), wherein the first polyalkylene glycol contains at least 30 wt % ethylene oxide units, alternatively at least 40 wt % EO units, alternatively at least 50 wt % EO units, or alternatively at least 60 wt % EO units; an effective amount of a random copolymer second polyalkylene glycol based on propylene oxide and butylene oxide, wherein at least 50 percent by weight of the second polyalkylene glycol is butylene oxide units; and an effective amount of at least one corrosion inhibitor selected from the group of sarcosines, amine salts of aliphatic phosphoric acid esters, and calcium dinonylnaphthalenesulfonate/carboxylates, is provided.

In some embodiments of the invention, a lubricant composition comprising: a random or block copolymer first polyalkylene glycol based on ethylene oxide and propylene oxide and having a high EO content, wherein the first polyalkylene glycol has a molecular weight of at least 500 g/mole, alternatively at least 800 g/mole, alternatively at least 1000 g/mole, alternatively at least 2000 g/mole, or alternatively at least 3500 g/mole; an effective amount of a random copolymer second polyalkylene glycol based on propylene oxide and butylene oxide, wherein at least 50 percent by weight of the second polyalkylene glycol is butylene oxide units; and an effective amount of at least one corrosion inhibitor selected from the group of sarcosines, amine salts of aliphatic phosphoric acid esters, and calcium dinonylnaphthalenesulfonate/carboxylates, is provided.

In a second aspect of the invention, a lubricant composition comprising: a random or block copolymer polyalkylene glycol based on ethylene oxide and propylene oxide, wherein at least 30 wt % of the polyalkylene glycol is ethylene oxide units, alternatively at least 40 wt % of the polyalkylene glycol is ethylene oxide units, alternatively at least 50 wt % of the polyalkylene glycol is ethylene oxide units, alternatively at least 60 wt % of the polyalkylene glycol is ethylene oxide units; 10-20 wt % of a polyalkylene homopolymer containing propylene oxide or butylene oxide units having a molecular weight between 400 and 1500 g/mole; and at least one corrosion inhibitor selected from the group consisting of (a) an amine salt of an aliphatic phosphoric acid ester; (b) an alkenyl succinic acid half ester in mineral oil; (c) an amine salt of an alkyl phosphoric acid combined with a dithiophosphoric acid derivative; (d) a combination of barium dinonylnaphthalene sulfonate and dinonylnaphthalene carboxylate in a hydrotreated naphthenic oil; and (e) combinations thereof is provided. Certain embodiments of such inventive aspect further comprise N-phenyl-1,1,3,3-tetramethylbutyl-naphthalen-1-amine, as a first antioxidant; alkylated diphenylamine formed from the reaction product of N-phenyl-benzeneamine and 2,4,4-trimethylpentene, or a mixed octylated and butylated diphenylamine, as a second antioxidant; a phosphorous based extreme pressure additive; and/or a yellow metal passivator.

In some embodiments of the invention, the lubricant composition comprises a random or block copolymer polyalkylene glycol which contains between 50 and 85 wt % ethylene oxide units, the remainder being polypropylene oxide units.

In certain embodiments of the invention, the phosphorus-based extreme pressure additive is selected from a group consisting of isopropylated triaryl phosphates; amine-phosphates; phosphor-thionates; acid phosphates; alkyl phosphates; and combinations thereof.

In specific embodiments of the lubricant composition comprises a yellow metal passivator which is selected from a group consisting of benzotriazole, tolytriazole, tolutriazole, mixtures of sodium tolytriazolee and sodium tolutriazole, and combinations thereof.

In preferred embodiment of the invention, the lubricant composition is capable of passing ASTM D665B for at least 24 hours following initiation.

In some embodiments, the invention provides a lubricant composition wherein the polyalkylene homopolymer is an n-butanol started butylene oxide homopolymer with a molecular weight between 400 and 600 g/mole. In other embodiments of the invention, the polyalkylene homopolymer is an n-butanol started propylene oxide homopolymer with a molecular weight between 900 and 1100 g/mole. In yet other embodiments, the polyalkylene homopolymer is a diol started propylene oxide homopolymer with a molecular weight between 900 and 1100 g/mole. In yet other embodiments, the polyalkylene homopolymer is diol started butylene oxide homopolymer with a molecular weight between 400 and 600 g/mole In a third aspect of the invention, a lubricant composition comprising: a random or block copolymer polyalkylene glycol based on ethylene oxide and propylene oxide having a molecular weight of at least 500 g/mole, alternatively, at least 800 g/mole, alternatively at least 1000 g/mole, alternatively at least 1500 g/mole, alternatively at least 2000 g/mole or alternatively at least 3500 g/mole, wherein at least 30 wt % of the polyalkylene glycol is ethylene oxide units; 10-20 wt % of a polyalkylene homopolymer containing propylene oxide or butylene oxide units having a molecular weight between 400 and 1500 g/mole; and at least one corrosion inhibitor selected from the group consisting of (a) an amine salt of an aliphatic phosphoric acid ester; (b) alkenyl succinic acid half ester in mineral oil; (c) an amine salt of an alkyl phosphoric acid combined with a dithiophosphoric acid derivative; (d) a combination of barium dinonylnaphthalene sulfonate and dinonylnaphthalene carboxylate in a hydrotreated naphthenic oil; and (e) combinations thereof is provided.

The lubricant compositions appear to have utility in both land- and sea-based uses, and in a variety of extreme environmental and mechanical conditions. Such applications include, for example, wind turbine gearboxes, subsea hydraulics, compressors, and other uses where stable viscosity, corrosion inhibition, wear reduction, and long life are particularly necessary. For example, the lubricant compositions preferably pass ASTM D665B for at least 24 hours after initiation.

PAGs suitable for use in the inventive lubricant and lubricant compositions are, in some non-limiting embodiments, selected from random and block copolymer glycols based on a mixed EO and PO feed. Because of their pour points which are typically lower, random copolymer glycols may be particularly useful herein. One or more PAGs may be used, hut the overall EO unit content preferably ranges from 30 wt percent to 95 wt percent, based on the total PAG weight, the remainder being PO units. The EO unit content more preferably ranges from 50 wt percent to 85 wt percent, and still more preferably from 60 wt percent to 70 wt percent, based on the total PAG weight, the remainder being PO units. The PAGs may be initiated using initiators that are monols, diols, triols, tetrols, higher polyfunctional alcohols, or combinations thereof. Non-limiting examples of monol initiators are n-butanol or dodecanol. One nonlimiting example of a diol initiator would be monoethylene glycol or monopropylene glycol ("MPG") and one nonlimiting example of a triol initiator is, for example, glycerol etc. In some non-limiting embodiments diols may be selected.

By way of illustration, but not by limitation, preparation of a suitable PAG for use in the inventive lubricant compositions may be by any means or method known to those skilled in the art. For example, ethane and propane may be oxidized to EO and PO, respectively, using, for instance, dilute acidic potassium permanganate or osmium tetroxide. Hydrogen peroxide may alternatively be used, in a reaction transforming the alkene to the alkoxide. EO and PO may then be polymerized to form random PAG co-polymers by simultaneous addition to the oxides to an initiator such as ethylene glycol or propylene glycol and using, for example, a base catalyst, such as potassium hydroxide, to facilitate the polymerization.

One may instead purchase a PAG copolymer base fluid. For example, SYNALOX® and UCON™ lubricant fluids are available from The Dow Chemical Company. In some non-limiting embodiments, those having a KV in the ISO viscosity range of 22 to 1000 (that is, a KV of from 22 cSt to 1,000 cSt at 40° C.) may be particularly effective, though a viscosity ranging from 220 cSt to 680 cSt at 40° C. may be selected for some applications. In some particular but non-limiting embodiments, an ISO viscosity grade of 320 may be selected. It may also be desirable to select a copolymer base fluid that is water soluble, rather than water insoluble, as a water soluble base fluid may provide improved friction control in certain applications.

Some embodiments of the invention may further comprise a yellow metal passivator. As used herein, "yellow metal" refers to a metallurgical grouping that includes brass and bronze alloys, aluminum bronze, phosphor bronze, copper, copper nickel alloys, and beryllium copper. Typical yellow metal passivators include, for example, benzotriazole, tolutriazole, tolyltriazole, mixtures of sodium tolutriazole and tolyltriazole, and combinations thereof. In one particular and non-limiting embodiment, a compound containing tolyltriazole is selected. Typical commercial yellow metal passivators include IRGAMET®-30, and IRGAMET®-42, available from Ciba Specialty Chemicals, now part of BASE, and VANLUBE® 601 and 704, and CUVAN® 303 and 484, available from R.T. Vanderbilt Company, Inc.

In some embodiments of the invention, the lubricant composition still further comprise at least one corrosion inhibitor selected from, (1) an amine salt of an aliphatic phosphoric acid ester (for example, NA-LUBE® AW6110, available from King Industries, Inc.); (2) an alkenyl succinic acid half ester in mineral oil (for example, IRGACOR™ L12, available from Ciba Chemicals Corporation); (3) an amine salt of an alkyl phosphoric acid combined with a dithiophosphoric acid derivative (for example, NA-LUBE® 6330, available from King Industries, Inc.); (4) a combination of barium dinonylnaphthalene sulfonate and dinonylnaphthalene carboxylate in a hydrotreated naphthenic oil (for example; NA-SUL® BSN, available from King Industries, Inc.); and (5) combinations thereof.

Other potential corrosion inhibitors useful in the lubricant compositions include IRGACOR® L17, IRGACOR® DSSG, IRGALUBE® 349, and SARKOSYL™ O from Ciba Specialty Chemicals, now a part of BASF and VANLUBE® 601, 601E, 704, 692 and 719 from R.T. Vanderbilt Company, Inc.

In some embodiments of the invention, the lubricant composition comprise a first antioxidant, N-phenyl-1,1,3,3-tetramethylbutyl-naphthalen-1-amine.

In some embodiments of the invention, the lubricant composition may further comprise a second antioxidant which may be an alkylated diphenylamine The alighted diphenylamine may be a reaction product of N-phenyl benzamine and 2,4,4-trimethylpentene, a mixture of octylated and butylated diphenylamines, or a combination thereof. A commercial example of the reaction product of N-phenyl benzamine and 2,4,4-trimethylpentene is IRGANOX® L57, available from Ciba Specialty Chemicals, now a part of BASF. A commercial example of mixed octylated and butylated diphenylamines is VANLUBE® 961, available from R.T. Vanderbilt Company, Inc.

The lubricant compositions may further include a phosphorous based extreme pressure additive, examples of which include isopropylated triaryl phosphates, amine-phosphates' phosphor-thionates, acid phosphates, alkyl phosphates (for example, dodecyl phosphate), and combinations thereof. DURAD® 310M, commercially available from Chemtura, is a combination of isopropylated triaryl phosphates with small amounts of dodecyl phosphate and triphenyl phosphate. Other extreme pressure additives include VANLUBE® 719, 7611, 727, 9123, each of which is commercially available from R.T. Vanderbilt Company, Inc.

The lubricant compositions include each specified component, but such components may vary over a range of proportions relative to one another while providing an overall lubricant composition with desirable properties. The PAG preferably ranges from 50 wt percent to 99 wt percent, preferably ≥70 wt percent, more preferably ≥80 wt percent. The polyalkylene homopolymer containing propylene oxide or butylene oxide units and having a molecular weight between 400 and 1500 Oriole preferably ranges from 10 wt percent to 20 wt percent, and is more preferably 15 wt percent. The first antioxidant preferably ranges from 0.1 wt percent to 5.0 wt percent, more preferably ≥0.5 wt percent and still more preferably ≥1.0 wt percent. The second antioxidant preferably ranges from 0.5 wt percent to 5.0 wt percent, more preferably ≥1.0 wt percent and still more preferably ≥1.3 wt percent. The extreme pressure additive preferably ranges from 0.1 wt percent to 3 wt percent, more preferably ≥1.5 wt percent and still more preferably ≥2 wt percent. The yellow metal passivator preferably ranges from 0.01 wt percent to 0.5 wt percent, more preferably from 0.05 wt percent to 0.1 wt percent. Corrosion inhibitors preferably range from 0.1 wt percent to 1.0 wt percent, more preferably from 0.2 wt percent to 0.75 wt percent, and still more preferably from 0.5 wt percent to 0.6 with percent. Each wt percent in this paragraph is based upon total lubricant composition weight.

The lubricant compositions may also include one or more conventional lubricant additives in addition to components specified above. Such additives include defoamers such as polymethylsiloxanes, demulsifiers, antioxidants, (for example, phenolic antioxidants, hindered phenolic antioxidants, additional sulfurized olefins, aromatic amine antioxidants, secondary amine antioxidants, sulfurized phenolic antioxidants, oil-soluble copper compounds, and mixtures thereof), copper corrosion inhibitors, rust inhibitors, pour point depressants, detergents, dyes, metal deactivators, supplemental friction modifiers, diluents, combinations thereof, and the like. The conventional lubricant additives, if present, typically range from 100 parts by weight per million parts by weight ("ppmw') of lubricant composition to 2 wt percent, based upon total lubricant composition weight.

The lubricant compositions may be prepared via any method known to those skilled the art. For example, typical blending equipment includes impeller mixers, tumble blenders, paddle and plow mixers, and single or double shaft mixers. Protocols generally prescribe charging first with a base fluid, herein a combination of PAG and polyalkylene homopolymer containing propylene oxide or butylene oxide units having a molecular weight between 400 and 1500 g/mole, followed by components that are used in relatively small proportion, herein antioxidants, extreme pressure additive, yellow metal passivator, corrosion inhibitors(s), and any additional additives that have been selected, in any order.

The above description and examples that follow illustrate, but do not limit, various aspects or embodiments of this invention.

Table 1 includes a description of the base oils and corrosion inhibitors used in the lubricant compositions of Inventive Examples 1-21 and Comparative Examples 1-15 discussed.

TABLE 1

| | Supplier | Chemistry |
|---|---|---|
| BASE OIL | | |
| SYNALOX ® 50-50B | Dow Chemical Co. | Butanol initiated random copolymer (EO/PO, 50/50 by wt.) with a typical molecular weight of 1,300 g/mole and a typical kinematic viscosity at 40° C. of 70 $mm^2/s$ (cSt). |
| SYNALOX ® 40-D150 | Dow Chemical Co. | Diol initiated random copolymer (EO/PO, 60/40 by wt) with a typical molecular weight of 1,900 g/mole and a typical kinematic viscosity at 40° C. of 220 $mm^2/s$ (cSt). |
| SYNALOX ® 100-30B | Dow Chemical Co. | Butanol initiated PO homopolymer with a typical molecular weight of 950 g/mole a typical kinematic viscosity at 40° C. of 46 $mm^2/s$ (cSt). |
| UCON ™ OSP-46 | Dow Chemical Co. | Alcohol initiated random copolymer (PO/BO, 50/50 by wt) with a typical kinematic viscosity at 40° C. of 46 $mm^2/s$ (cSt). |
| UCON ™ OSP-220 | Dow Chemical Co. | Alcohol initiated random copolymer (PO/BO, 50/50 by wt) with a typical kinematic viscosity at 40° C. of 220 $mm^2/s$ (cSt). |
| CORROSION INHIBITORS | | |
| Sarkosyl O | BASF | N-oleyl sarcosine, Typical kinematic viscosity at 40° C. of 350 $mm^2/s$ (cSt) and a typical acid number of 160 mg KOH/g, and 3.7 wt % nitrogen |
| NA-SUL ® CA1082 | King Industries | Calcium dinonylnaphthalenesulfonate/carboxylate in light mineral oil, calcium content = 1.4%, Typical kinematic viscosity at 40° C. of 795 $mm^2/s$ (cSt) and a typical acid number of 100 mgKOH/g |
| NA-SUL ® AW 6110 | King Industries | Amine salts of aliphatic phosphoric acid esters, typical kinematic viscosity at 40° C. of 448 $mm^2/s$ (cSt), nitrogen content = 1.8% and phosphorus content = 8.2% |

PREPARATION OF INVENTIVE EXAMPLES AND COMPARATIVE EXAMPLES 500 g of each Inventive and Comparative Example was prepared in a 1 liter glass beaker fitted with an electric stirrer to provide mixing. The formulations were prepared by adding the highest weight percentage component first, then the second highest percentage component and then if needed the third highest percentage component. Each of the Inventive and Comparative Example compositions shown in Tables 2 and 3 were one-phase and homogeneous.

"Comprising" may, unless stated to the contrary, include any additional additive, adjuvant, or compound whether polymeric or otherwise. In contrast, "consisting essentially of" excludes from the scope of any succeeding recitation any other component, step or procedure, except those that are not essential to operability. "Consisting of" excludes any component, step or procedure not specifically delineated or listed. Unless stated otherwise, "or" refers to the listed members individually as well as in any combination.

Corrosion Testing

All corrosion tests were conducted according to ASTM D665A and/or D665B (ASTM D665-06 Standard Test Method for Rust-Preventing Characteristics of inhibited Mineral Oil in the Presence of Water). Briefly, this test involves mixing 10 wt % water (either deionized or salt water) with 90 wt % of the lubricant composition to be tested. A steel test pin is submerged in the lubricant/water mixture at 60° C. Results may be reported after 4 and/or 24 hours. ASTM D665 standard provides solely for a Pass (P) or Fail (F) rating.

In addition to the ASTM D665 P/F rating, some of the examples discussed herein were rated on a scale from 1 to 5 wherein: 5 indicates a clean metal surface; 4 indicates minor discoloration of the pin but no corrosion; 3 indicates heavy discoloration of the pin but no corrosion; 2 indicates minor corrosion observed on parts of the steel pin; and 1 indicates all of the steel pin is heavily corroded. Ratings of 5-4 in this customized test are a "Pass" corresponding to ASTM D665B.

Preparation of Lubricant Compositions of Inventive Examples 1-18 and Comparative Examples 146

Lubricant compositions of Inventive Examples 1-18 are shown in Table 2. Compositions of Comparative Examples 1-16 are shown in Table 3. All percentages shown are weight percentage.

TABLE 2

| | |
|---|---|
| Inventive Ex. 1 | Synalox 50-50B + 5 wt % OSP-46 + 1 wt % Sarkosyl O |
| Inventive Ex. 2 | Synalox 50-50B + 10 wt % OSP-46 + 1 wt % Sarkosyl O |
| Inventive Ex. 3 | Synalox 50-50B + 20 wt % OSP-46 + 1 wt % Sarkosyl O |
| Inventive Ex. 4 | Synalox 50-50B + 50 wt % OSP-46 + 11 wt % Sarkosyl O |
| Inventive Ex. 5 | Synalox 50-50B + 5 wt % OSP-46 + 1 wt % Na-Lube AW6110 |
| Inventive Ex. 6 | Synalox 50-50B + 5 wt % OSP-46 + 0.5 wt % Na-Lube AW6110 |
| Inventive Ex. 7 | Synalox 50-50B + 10 wt % OSP-46 + 0.5 wt % Na-Lube AW6110 |
| Inventive Ex. 8 | Synalox 50-50B + 20 wt % OSP-46 + 0.5 wt % Na-Lube AW6110 |
| Inventive Ex. 9 | Synalox 50-50B + 50 wt % OSP-46 + 0.5 wt % |

TABLE 2-continued

| | |
|---|---|
| | Na-Lube AW6110 |
| Inventive Ex. 10 | Synalox 50-50B + 50 wt % OSP-46 + 1 wt % Na-sul CA1082 |
| Inventive Ex. 11 | Synalox 50-50B + 10 wt % OSP-220 + 1 wt % Sarkosyl O |
| Inventive Ex. 12 | Synalox 50-50B + 20 wt % OSP-220 + 1 wt % Sarkosyl O |
| Inventive Ex. 13 | Synalox 50-50B + 50 wt % OSP-220 + 1 wt % Sarkosyl O |
| Inventive Ex. 14 | Synalox 50-50B + 5 wt % OSP-220 + 1 wt % Na-Lube AW6110 |
| Inventive Ex. 15 | Synalox 50-50B + 5 wt % OSP-220 + 0.5 wt % Na-Lube AW6110 |
| Inventive Ex. 16 | Synalox 50-50B + 10 wt % OSP-220 + 0.5 wt % Na-Lube AW6110 |
| Inventive Ex. 17 | Synalox 50-50B + 20 wt % OSP-220 + 0.5 wt % Na-Lube AW6110 |
| Inventive Ex. 18 | Synalox 50-50B + 50 wt % OSP-220 + 0.5 wt % Na-Lube AW6110 |

TABLE 3

| | Composition |
|---|---|
| Comparative Ex. 1 | Synalox 50-50B |
| Comparative Ex. 2 | Synalox 50-50B + 1 wt % Sarkosyl O |
| Comparative Ex. 3 | Synalox 50-30B + 1 wt % Sarkosyl O |
| Comparative Ex. 4 | Synalox 40-D150 + 1 wt % Sarkosyl O |
| Comparative Ex. 5 | Synalox 100-30B + 1 wt % Sarkosyl O |
| Comparative Ex. 6 | Synalox 50-50B + 5 wt % OSP-46 |
| Comparative Ex. 7 | Synalox 50-50B + 10 wt % OSP-46 |
| Comparative Ex. 8 | Synalox 50-50B + 20 wt % OSP-46 |
| Comparative Ex. 9 | Synalox 50-50B + 50 wt % OSP-46 |
| Comparative Ex. 10 | Synalox 50-50B + 5 wt % OSP-220 |
| Comparative Ex. 11 | Synalox 50-50B + 10 wt % OSP-220 |
| Comparative Ex. 12 | Synalox 50-50B + 20 wt % OSP-220 |
| Comparative Ex. 13 | Synalox 50-50B + 50 wt % OSP-220 |
| Comparative Ex. 14 | Synalox 50-50B + 1 wt % Na-Lube AW6110 |
| Comparative Ex. 15 | Synalox 50-50B + 0.5 wt % Na-Lube AW6110 |
| Comparative Ex. 16 | Synalox 50-50B + 1.0 wt % Na-sul CA1082 |

Each of the lubricant compositions of Inventive Examples 1-18 passed ASTM D665B at 24 hours whereas each of the Comparative Examples 1-16 failed ASTM D665B at 24 hours.

Additional lubricant compositions were prepared as follows. Inventive Example 19 contained Synatox® 50-50B and 5 wt % OSP™-46 as the base fluid and 1 wt % Sarkosyl™ O. Inventive Example 20 contained Synalox® 50-50B and 10 wt % OSP-46 as the base fluid and 1 wt % Na-sul® CA 1082. Inventive Example 21 contained Synalox® 50-50B and 20 wt % UCON™ OSP-46 as the base fluid and 1 wt % Na-sul® CA1082. Each of Inventive Examples 19-21 passed ASTM D665E3 at 4 hours but failed at 24 hours.

Preparation of Lubricant Compositions of Inventive Examples 22-25 and Comparative Examples 17-18

The materials used to prepare lubricant Inventive Examples 22-25 and Comparative Examples 17-18, the compositions of which are given in Table 4, include the following:

Polyglycol Base Fluids

Synalox® OA15 which is an n-butanol started butylene oxide homopolymer with a molecular weight of 500 g/mole;

Synalox® OD 40 which is a diol started butylene oxide homopolymer with a molecular weight of 500 g/mole;

Synalox® 100-30B which is an n-butanol started propylene oxide homopolymer with a molecular weight of 950 g/mole;

Synalox® 100-D 45 which is a diol started propylene oxide homopolymer with a molecular weight of 1000 g/mole; and Synalox® 40 D-300 which is an MPG started ethylene oxide/propylene oxide (60/40 by random copolymer with a molecular weight of 4000 g/mole.

"Synalox" is a registered trademark of The Dow Chemical Company and all Synalox® materials were obtained therefrom.

Ester Basestocks

Hercolube® J is a pentaerythritol-based polyol ester having a kinematic viscosity of 25 cSt at 40° C.

"Hercolube" is a registered trademark of Hercules Powder Company Corporation and the Hercolube® J material was obtained therefrom.

Antioxidants

Irganox® L06 is N-phenyl-ar-(1,1,3,3-tetramethylbutyl)-1-naphthalenamine; and

Irganox® L57 contains the benzeneamine and N-phenyl-reaction products with 2,4,4-trimethylpentene diphenylamine.

"Irganox" is a registered trademark of the Ciba Specialty Chemicals Corporation, now a part of BASF and all Irganox® materials were obtained therefrom.

Na-Lube® AW-6110 is a composition containing amine salts of aliphatic phosphoric acid esters (8.2 wt % phosphorous and 1.8 wt % nitrogen) and has a viscosity at 40° C. (according to ASTM D 445, DIN 51 550) of 448 $mm^2/s$ (cSt). "NA-LUBE" is a registered trademark of King Industries, Inc. and the NA-LUBE material was obtained therefrom.

Extreme Pressure Additives

DURAD™ 310M is a mixed organophosphate ester having a viscosity at 40° C. of 51 cSt.

DURAD materials were Obtained Chemtura Corporation.

Yellow Metal Passivator

Tolytriazole is 5-methyl benzotriazole and was obtained from Ciba Specialty Chemicals, now a part of BASF.

Antifoaming Additive

Dow Corning DCF200-12500 is a polymethylsiloxane antifoam agent having a viscosity of 12500 cSt at 25° C. and a specific gravity of 0.97 obtained from Dow Corning Corporation

TABLE 4

| Component | Comp. Ex. 17 | Comp. Ex. 18 | Inv. Ex. 22 | Inv. Ex. 23 | Inv. Ex. 24 | Inv. Ex. 25 |
|---|---|---|---|---|---|---|
| Synalox 40D300 | 80.5 | 95.5 | 80.5 | 80.5 | 80.5 | 80.5 |
| Synalox 100-D45 | — | — | 15.0 | — | — | — |
| Synalox OA 15 | — | — | — | 15.0 | — | — |
| Synalox 100-30B | — | — | — | — | 15.0 | — |
| Synalox OD-40 | — | — | — | — | — | 15.0 |
| Hercolube J (Polyol ester) | 15.0 | — | — | — | — | — |
| Irganox L06 | 1.0 | 1.0 | 1.0 | 1.0 | 1.0 | 1.0 |
| Irganox L57 | 1.3 | 1.3 | 1.3 | 1.3 | 1.3 | 1.3 |
| DURAD 310M | 1.5 | 1.5 | 1.5 | 1.5 | 1.5 | 1.5 |
| Tolytriazole | 0.1 | 0.1 | 0.1 | 0.1 | 0.1 | 0.1 |
| DCF200-12500 | 0.002 | 0.002 | 0.002 | 0.002 | 0.002 | 0.002 |
| Na-Lube AW6110 | 0.6 | 0.6 | 0.6 | 0.6 | 0.6 | 0.6 |

TABLE 5

| | Comp. Ex. 17 | Comp. Ex. 18 | Inv. Ex. 22 | Inv. Ex. 23 | Inv. Ex. 24 | Inv. Ex. 25 |
|---|---|---|---|---|---|---|
| Visual appreciation; phase | One phase | One phase | One phase | One phase | One phase | One phase |
| Appearance | Clear | Clear | Clear | Clear | Clear | Clear |
| Visc. 40° C. [cSt] (ASTM 445) | 309 | 462 | 353 | 328 | 281 | 329 |
| Visc. 100° C. [cSt] (ASTM 445) | 53 | 75 | 56 | 52 | 48 | 56 |
| Viscosity index (ASTM D2270) | 237 | 244 | 227 | 223 | 232 | 237 |
| Density 15° C. (ASTM D7042) | 1.058 | 1.077 | 1.067 | 1.062 | 1.054 | 1.062 |
| Density 40° C. (ASTM D7042) | 1.039 | 1.058 | 1.048 | 1.043 | 1.035 | 1.043 |
| Density 100° C. (ASTM D7042) | 0.994 | 1.012 | 1.002 | 0.997 | 0.989 | 0.997 |
| Corrosion Testing | | | | | | |
| ASTM 665 B (after 24 hours) | Pass | Fail | Pass | Pass | Pass | Pass |
| 1-5 Corrosion Rating as described herein. | 4 | 2 | 4 | 4 | 5 | 5 |

As can be seen in Table 5, Inventive Examples 22-25 passed ASTM D665B at 24 hours as did Comparative Example 17 which contained a polyol ester. Comparative Example 18, which contained neither a polyol ester nor a polyalkylene homopolymer containing propylene oxide or butylene oxide did not pass ASTM D665B at 24 hours.

Additional inventive lubricant compositions, Inventive Examples 26-33, and comparative lubricant compositions, Comparative Examples 1-20, were prepared, as previously described, with the compositions provided in Table 6. SYNALOX® 40-D220 is an EO/PO (60/40 wt/wt) random copolymer that is diol initiated with a mol weight of 2500 g/mole. SYNALOX® 50-15B is an EO/PO (50/50 wt/wt) random copolymer that is butanol initiated with a mol weight of 500 g/mole

TABLE 6

| Example | | ASTM D665B 4 hours | ASTM D665B 24 hours |
|---|---|---|---|
| Comparative Example 19 | SYNALOX 40-D220 - 99.5%<br>Na-Lube AW6110 - 0.5% | P | F |
| Inventive Example 26 | SYNALOX 40-D220 - 94.5%<br>Na-Lube AW6110 - 0.5%<br>UCON ™ OSP-46 - 5% | P | P |
| Inventive Example 27 | SYNALOX 40-D220 - 89.5%<br>Na-Lube AW6110 - 0.5%<br>UCON ™ OSP-46 - 10% | P | P |
| Inventive Example 28 | SYNALOX 40-D220 - 79.5%<br>Na-Lube AW6110 - 0.5%<br>UCON ™ OSP-46 - 20% | P | P |

TABLE 6-continued

| Example | | ASTM D665B 4 hours | ASTM D665B 24 hours |
|---|---|---|---|
| Inventive Example 29 | SYNALOX 40-D220 - 49.5%<br>Na-Lube AW6110 - 0.5%<br>UCON ™ OSP-46 - 50% | P | P |
| Comparative Example 20 | SYNALOX 50-15B - 99.5%<br>Na-Lube AW6110 - 0.5% | P | F |
| Inventive Example 30 | SYNALOX 50-15B - 94.5%<br>Na-Lube AW6110 - 0.5%<br>UCON ™ OSP-46 - 5% | P | F |
| Inventive Example 31 | SYNALOX 50-15B - 89.5%<br>Na-Lube AW6110 - 0.5%<br>UCON ™ OSP-46 - 10% | P | F |
| Inventive Example 32 | SYNALOX 50-15B - 79.5%<br>Na-Lube AW6110 - 0.5%<br>UCON ™ OSP-46 - 20% | P | F |
| Inventive Example 33 | SYNALOX 50-15B - 49.5%<br>Na-Lube AW6110 - 0.5%<br>UCON ™ OSP-46 - 50% | P | F |

ASTM D665B testing on Inventive Examples 26-33 indicates that lubricant base fluids having a base fluid component high in EO content provides better corrosion resistance when the high EO content base fluid component has a higher molecular weight. Inventive Examples 30-prepared with Synalox 50-15B, which has a substantially lower molecular weight than that of Synalox 40D-220, passed ASTM D665B at 4 hours but failed at 24 hours. In contrast, Inventive Examples 26-29, which included the higher molecular weight and higher EO content Synalox 40D-220, passed ASTM D665B at both 4 and 24 hours.

We claim:

1. A lubricant composition comprising:

a random or block copolymer first polyalkylene glycol based on ethylene oxide and propylene oxide, wherein at least 30 percent by weight of the polyalkylene glycol is ethylene oxide units;

an effective amount of a random copolymer second polyalkylene glycol based on propylene oxide and butylene oxide, wherein the second polyalkylene glycol comprises between 50 and 75 wt % butylene oxide units; and an effective amount of at least one corrosion inhibitor selected from the group of sarcosines, amine phosphates, and calcium dinonylnaphthalenesulfonate/carboxylates.

2. The lubricant composition of claim 1 wherein the effective amount of the second polyalkylene glycol is between 5 and 50 wt %.

3. The lubricant composition of claim 1 wherein the effective amount of the corrosion inhibitor is between 0.25 and 1.5 wt %.

4. The lubricant composition of claim 1 wherein the first polyalkylene glycol has a kinematic viscosity at 40° C. between 30 and 250 $mm^2/s$ (cSt).

5. The lubricant composition of claim 1 wherein the lubricant composition is capable of passing ASTM D665B for at least 24 hours after initiation.

6. A lubricant composition for use in extreme conditions comprising:

a random or block copolymer polyalkylene glycol based on ethylene oxide and propylene oxide having a molecular weight greater than 2,000 g/mole and wherein at least 30 wt % of the copolymer polyalkylene glycol is ethylene oxide units;

10-20 wt % of a polyalkylene homopolymer having propylene oxide and butylene oxide units having a molecular weight between 400 and 1500 g/mole and comprises between 50 and 75 wt % butylene oxide units; and at least one corrosion inhibitor selected from the group consisting of (a) an amine salt of an aliphatic phosphoric acid ester; (b) an amine salt of an alkyl phosphoric acid combined with a dithiophosphoric acid derivative; (c) a combination of barium dinonylnaphthalene sulfonate and dinonylnaphthalene carboxylate in a hydrotreated naphthenic oil; and (d) combinations thereof.

7. The lubricant composition of claim 6 further comprising:

N-phenyl-1,1,3,3-tetramethylbutyl-naphthalen-1-amine, as a first antioxidant;

an alkylated diphenylamine formed from the reaction product of N-phenyl-benzeneamine and 2,4,4-trimethylpentene, or a mixed octylated and butylated diphenylamine, as a second antioxidant;

a phosphorous based extreme pressure additive; and a yellow metal passivator.

8. The lubricant composition of claim 6 wherein the random or block copolymer polyalkylene glycol contains between 50 and 85 wt % ethylene oxide units, the remainder being polypropylene oxide units.

9. The lubricant composition of claim 7 wherein the phosphorus-based extreme pressure additive is selected from a group consisting of isopropylated triaryl phosphates; amine-phosphates; phosphor-thionates; acid phosphates; alkyl phosphates; and combinations thereof.

10. The lubricant composition of claim 7 wherein the yellow metal passivator is selected from a group consisting of benzotriazole, tolyltriazole, tolutriazole, mixtures of sodium tolyltriazole and sodium tolutriazole, and combinations thereof.

11. The lubricant composition of claim 6 capable of passing ASTM D665B for at least 24 hours following initiation.

12. The lubricant composition of claim 6 wherein the polyalkylene homopolymer is an n-butanol started butylene oxide homopolymer with a molecular weight between 400 and 600 g/mole.

13. The lubricant composition of claim 6 wherein the polyalkylene homopolymer is an n-butanol started propylene oxide homopolymer with a molecular weight between 900-1100 g/mole.

14. The lubricant composition of claim 6 wherein the polyalkylene homopolymer is a diol started propylene oxide homopolymer with a molecular weight between 900 and 1100 g/mole.

15. The lubricant composition of claim 6 wherein the polyalkylene homopolymer is diol started butylene oxide homopolymer with a molecular weight between 400-600 g/mole.

* * * * *